US009944376B1

(12) United States Patent
Waisanen et al.

(10) Patent No.: US 9,944,376 B1
(45) Date of Patent: Apr. 17, 2018

(54) ACTIVELY TUNABLE EXHAUST SYSTEMS FOR OUTBOARD MARINE ENGINES

(71) Applicant: Brunswick Corporation, Lake Forest, IL (US)

(72) Inventors: Andrew S. Waisanen, Fond du Lac, WI (US); Jeffrey C. Etapa, Oakfield, WI (US)

(73) Assignee: Brunswick Corporation, Mettawa, IL (US)

( * ) Notice: Subject to any disclaimer, the term of this patent is extended or adjusted under 35 U.S.C. 154(b) by 66 days.

(21) Appl. No.: 15/088,656

(22) Filed: Apr. 1, 2016

(51) Int. Cl.

| | |
|---|---|
| ***B63H 21/32*** | (2006.01) |
| ***F01N 1/08*** | (2006.01) |
| ***F01N 13/00*** | (2010.01) |
| ***B63H 20/24*** | (2006.01) |

(52) U.S. Cl.
CPC ..... *B63H 20/245* (2013.01)

(58) Field of Classification Search
CPC ..... B63H 20/245; B63H 20/24; F01N 13/12
USPC ..... 440/89 R, 89 C, 89 E, 89 F, 89 G, 89 H, 440/89 J
See application file for complete search history.

(56) References Cited

U.S. PATENT DOCUMENTS

| | | | | |
|---|---|---|---|---|
| 1,824,737 | A * | 9/1931 | Johnson | F01N 3/043 440/53 |
| 3,967,446 | A | 7/1976 | Harralson et al. | |
| 4,601,666 | A * | 7/1986 | Wood, Jr. | F01N 13/087 440/89 G |
| 4,668,199 | A | 5/1987 | Freund et al. | |
| 4,952,182 | A | 8/1990 | Curtis et al. | |
| 5,348,500 | A * | 9/1994 | Lassanske | B63H 20/245 440/86 |
| 8,876,566 | B1 | 11/2014 | Hilbert et al. | |
| 9,051,041 | B2 | 6/2015 | Litjens et al. | |

* cited by examiner

*Primary Examiner* — Daniel V Venne
(74) *Attorney, Agent, or Firm* — Andrus Intellectual Property Law, LLP

(57) ABSTRACT

Exhaust systems are for outboard marine engines that are configured to propel a marine vessel in a body of water. An intermediate exhaust conduit is configured to receive the exhaust gas from the primary exhaust conduit. A primary muffler receives the exhaust gas from a intermediate exhaust conduit. A secondary muffler receives the exhaust gas from the primary muffler. An idle relief outlet discharges the exhaust gas from the secondary muffler to atmosphere. A bypass valve is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

19 Claims, 5 Drawing Sheets

ACTIVELY TUNABLE EXHAUST SYSTEMS FOR OUTBOARD MARINE ENGINES

FIELD

The present disclosure relates to exhaust systems for marine engines, and particularly to actively tunable exhaust systems for outboard marine engines.

BACKGROUND

FIG. 1 depicts a conventional exhaust system A for an outboard marine engine. Dry exhaust gas is conveyed from an internal combustion engine via a vertical exhaust pipe B to a lower gearcase cavity C, wherein the exhaust gas is allowed to expand. When the internal combustion engine is operated at above-idle speeds, most or all of the exhaust gas is discharged via an underwater outlet D, which typically is formed through the gearcase and an associated propeller assembly. When the internal combustion engine is operated at idle speed, the pressure associated with the body of water in which the propeller assembly is situated typically prevents a significant flow of the exhaust gas through the underwater outlet D. Most or all of the exhaust gas tends to take a path of least resistance to atmosphere, which is through an idle relief muffler E and then through an idle relief outlet F. The idle relief outlet F is located above the body of water in which the outboard marine engine is situated.

The following U.S. Patents disclose additional state of the art. These patents are incorporated herein by reference, in entirety:

U.S. Pat. No. 9,051,041 discloses a marine propulsion system for propelling a marine vessel in water. The system comprises an outboard motor that is coupled to a marine vessel. The system comprises an exhaust gas relief outlet that is located above the water when the outboard motor is operated at idle speed. A conduit conveys exhaust gas from the exhaust gas relief outlet to a discharge outlet located on the marine vessel.

U.S. Pat. No. 8,876,566 discloses a marine drive and marine exhaust pipe that include a main exhaust flow chamber and an auxiliary idle relief chamber. The auxiliary idle relief chamber vents exhaust above the surface of the body of water in which the vessel is operating.

U.S. Pat. No. 4,952,182 discloses an exhaust relief system for an outboard motor that includes an exhaust chamber into which exhaust is discharged from the engine. A first passage in communication with the exhaust chamber provides contraction of the exhaust as the exhaust passes rearwardly from which the exhaust is discharged into an expansion chamber which substantially surrounds the exhaust chamber. From the expansion chamber, the exhaust is routed through and contracted into a second passage in communication with the expansion chamber, after which it is discharged to atmosphere. The tortuous path provided by the exhaust relief system, along with the repeated expansion and contraction of the exhaust as it flows to atmosphere, provides a muffling effect at idle operation.

U.S. Pat. No. 4,668,199 discloses an exhaust system for an outboard motor that includes a main exhaust passageway extending through a partially water filled chamber in the drive shaft housing. An inlet idle relief passage connects the top of the chamber with the main exhaust passageway and an outlet passage connects the top of the chamber with the atmosphere.

U.S. Pat. No. 3,967,446 discloses a tuned exhaust gas relief system for marine propulsion systems, for example an outboard motor, that includes a lower drive shaft housing coupled to a two stroke engine by a pair of intermediate stacked exhaust extension plates. The housing directs the exhaust gas downwardly to a through-the-hub exhaust propeller for exit there through. With the unit in reverse or idling, exhaust gases are trapped within the housing. A pair of tuned exhaust relief passageways may be formed by cavities in the mating faces of the two extension plates with a pair of inlet openings in the lower wall of the bottom plate. A baffle member may overlie the inlet openings. The passageways define constant cross-sectional area channels which terminate in exhaust openings in the rear wall of the drive shaft housing.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, an exhaust system is for an outboard marine engine that is configured to propel a marine vessel in a body of water. The exhaust system comprises a primary exhaust conduit having an upstream end configured to receive exhaust gas from an internal combustion engine and a downstream end configured to discharge the exhaust gas to the body of water via a gearcase cavity. An intermediate exhaust conduit is coupled to the primary exhaust conduit between the upstream end and the downstream end of the primary exhaust conduit. The intermediate exhaust conduit is configured to receive the exhaust gas from the primary exhaust conduit. An idle relief outlet is configured to discharge the exhaust gas to atmosphere. The idle relief outlet is configured to be located above the body of water at least when the outboard marine engine is operated at an idle speed. A bypass valve is positionable into an open position wherein the exhaust gas is permitted to flow to atmosphere via the intermediate exhaust conduit and into a closed position wherein the exhaust gas is not permitted to flow to atmosphere via the intermediate exhaust conduit. Optionally, a muffler receives the exhaust gas from the intermediate exhaust conduit and discharges the exhaust gas to the idle relief outlet.

In certain examples, the exhaust system comprises a primary muffler that receives the exhaust gas from the intermediate exhaust conduit and a secondary muffler receives the exhaust gas from the primary muffler. An idle relief outlet discharges the exhaust gas from the secondary muffler to atmosphere. A bypass valve is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

Outboard marine engines are also disclosed having the above summarized exemplary exhaust systems according to the present disclosure.

BRIEF DESCRIPTION OF THE DRAWINGS

The present disclosure is described with reference to the following drawing FIGURES. The same numbers are used throughout the FIGURES to reference like features and like components.

DETAILED DESCRIPTION OF THE DRAWINGS

Figure 1:
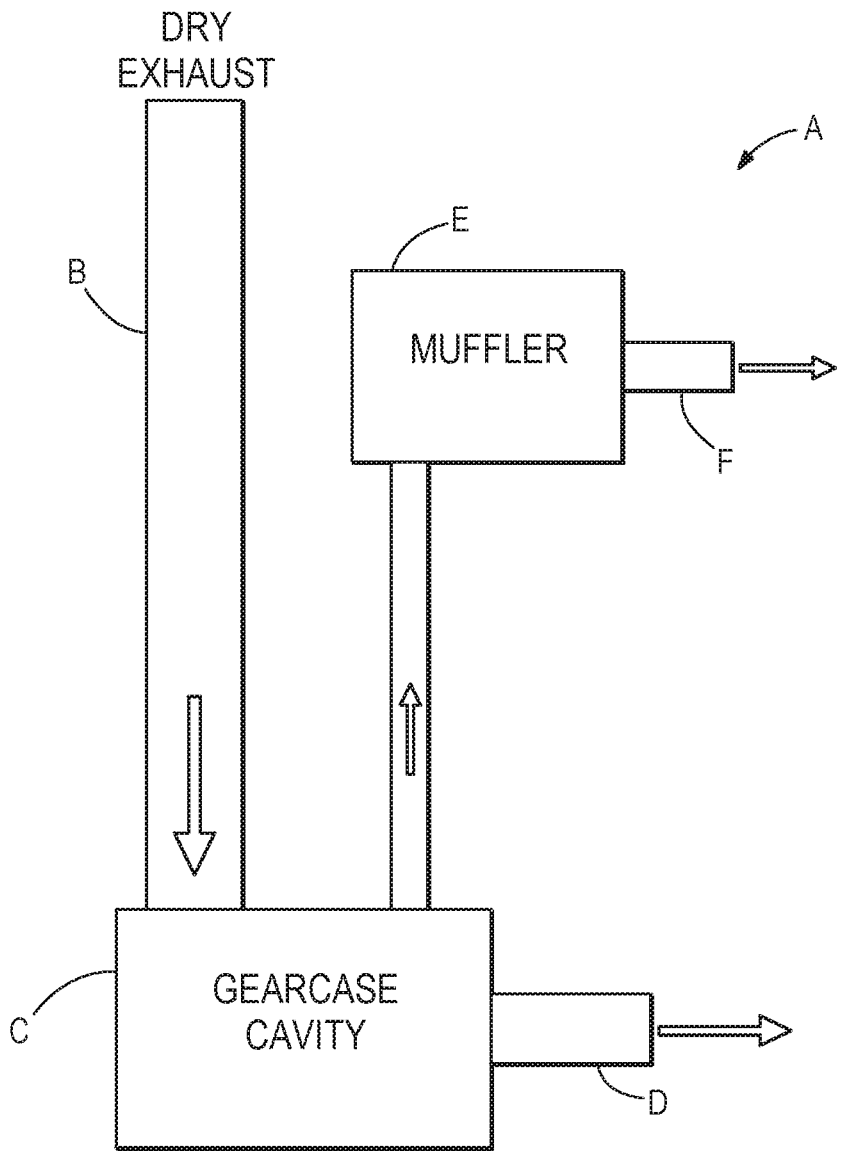
FIG. 1 PRIOR ART
FIG. 1 is a schematic view of a prior art exhaust system for an outboard marine engine.

Through research and development, the inventors have determined that noise requirements and expectations for a given outboard marine engine can vary depending upon the operator application. For example, performance boaters may desire a louder, more aggressive sound quality than recreational boaters. Referring to FIG. 1, which is described herein above, the present inventors have determined that conventional exhaust systems for outboard marine engines do not adequately allow an operator to actively tune the exhaust system. More specifically, the present inventors have determined that it would be desirable to provide actively tunable exhaust systems for outboard marine engines, wherein the operator is given the ability to select between a variety of exhaust sounds and/or performances. The present disclosure is a result of the inventors' research and experimentation directed towards providing the operator of an outboard marine engine with the ability to select a particular sound quality of the exhaust system.

Figure 3:
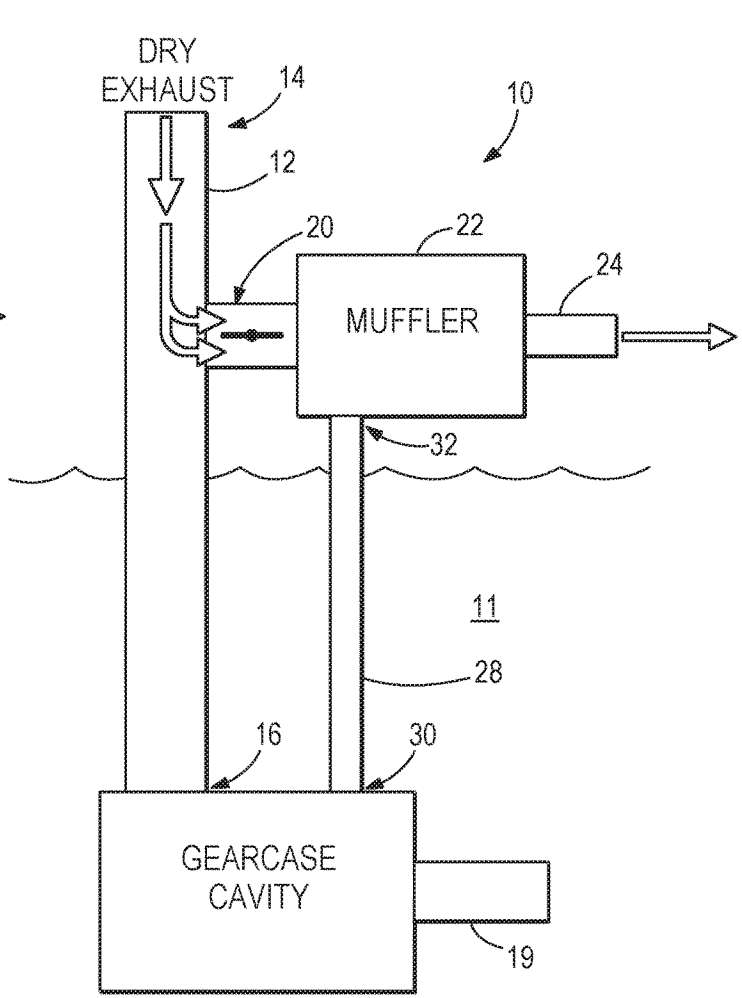
FIG. 3 is another schematic view of the exhaust system shown in FIG. 2.
Figure 2:
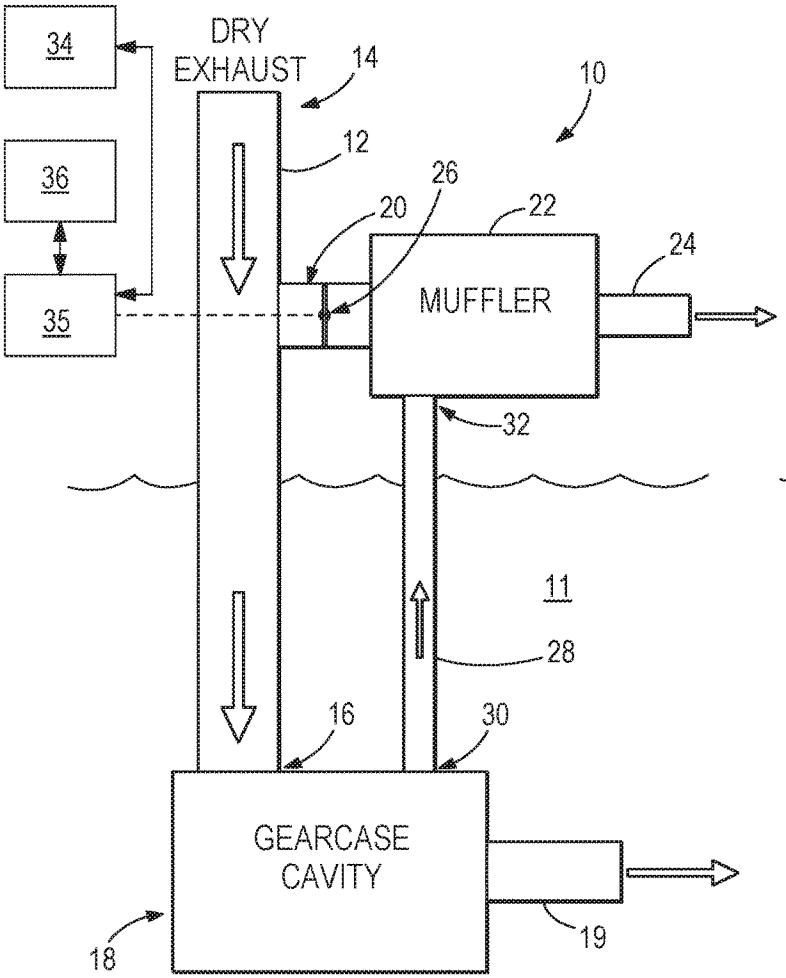
FIG. 2 is a schematic view of a first exemplary exhaust system for an outboard marine engine according to the present disclosure.

FIGS. 2 and 3 depict a first example of the present disclosure. FIGS. 4-7 depict a second example of the present disclosure.

Referring first to FIGS. 2 and 3, an exemplary exhaust system 10 is schematically depicted for use with an outboard marine engine. As is conventional, the outboard marine engine has an internal combustion engine (not shown) and is configured to propel a marine vessel in a body of water 11 according to known principles. FIGS. 2 and 3 are schematic in nature and do not depict the internal combustion engine; however internal combustion engines are well known in the art, examples of which being described in the above-referenced U.S. Patents. The exhaust system 10 includes a primary exhaust conduit 12 having an upstream end 14 that is configured to receive hot, dry exhaust gas from the noted internal combustion engine and a downstream end 16 that is configured to discharge the exhaust gas to the body of water 11 via a gearcase cavity 18 of the outboard marine engine. The manner in which the exhaust gas is discharged from the gearcase cavity 18 can vary. In certain examples, the exhaust gas is discharged via a propeller housing outlet 19 that is located in the body of water 11 when the outboard marine engine is in use. This is a conventional arrangement for discharging the exhaust gas from an outboard motor and thus the propeller housing outlet 19 is schematically shown and is not further described herein.

An intermediate exhaust conduit 20 is coupled to the primary exhaust conduit 12 between the upstream end 14 and the downstream end 16. The intermediate exhaust conduit 20 receives the exhaust gas from the primary exhaust conduit 12. Optionally, a muffler (sometimes referred to in the art as an "idle relief muffler") 22 receives the exhaust gas from the intermediate exhaust conduit 20 and discharges the exhaust gas to an idle relief outlet 24, which typically is formed through a cowling of the outboard marine engine. In other examples, the intermediate exhaust conduit 20 discharges the exhaust gas to the idle relief outlet 24 without passing through a muffler. In these examples, the intermediate exhaust conduit 20 and/or idle relief outlet 24 can form a tuned outlet duct that exits the cowl of the outboard marine engine separately or through the idle relief outlet 24. The idle relief outlet 24 is configured to discharge the exhaust gas to atmosphere. More specifically, the idle relief outlet 24 is configured to be located above the body of water 11 in which the outboard marine engine is operating, at least when the outboard marine engine is operated at an idle speed.

According to the present disclosure, a bypass valve 26 is coupled to and/or located in the intermediate exhaust conduit 20 between the primary exhaust conduit 12 and the idle relief outlet 24. The type of bypass valve 26 can vary and in certain examples can be a conventional mechanically-controlled valve and in other examples can be a conventional electrically-controlled valve. The bypass valve 26 is positionable into an open position, shown in FIG. 3, wherein the exhaust gas is permitted to flow through the intermediate exhaust conduit 20 from the primary exhaust conduit 12 to the muffler 22 and idle relief outlet 24. Thus, in the open position, the exhaust gas is allowed to bypass the downstream end 16 of the primary exhaust conduit 12 and bypass the gearcase cavity 18 and flow directly from the primary exhaust conduit 12 to the idle relief outlet 24 via the intermediate exhaust conduit 20 and optionally via the muffler 22. The bypass valve 26 is alternately positionable into a closed position, shown in FIG. 2, wherein the exhaust gas is not permitted to flow through the intermediate exhaust conduit 20 from the primary exhaust conduit 12, and thus is not allowed to bypass the downstream end 16 of the primary exhaust conduit 12 and gearcase cavity 18. Instead the exhaust gas is forced to bypass most of or all of the intermediate exhaust conduit 20 and flow to the gearcase cavity 18 for subsequent discharge to the body of water via the propeller housing outlet 19 and/or to atmosphere via the muffler 22 and idle relief outlet 24, which are connected to the gearcase cavity 18 by a secondary exhaust conduit 28. The secondary exhaust conduit 28 has an upstream end 30 that is configured to receive the exhaust gas from the gearcase cavity 18 and a downstream end 32 that is configured to discharge the exhaust gas to the muffler 22, for subsequent discharge via the idle relief outlet 24.

In some examples, the bypass valve 26 can be positionable into one or more intermediate position(s) wherein, as compared to the noted open position, a reduced amount of the exhaust gas is permitted to bypass the downstream end 16 of the primary exhaust conduit 12 and gearcase cavity 18. In other words, when the bypass valve 26 is in the intermediate position(s), some of the exhaust gas is allowed to bypass the downstream end 16 of the primary exhaust conduit 12 and bypass the gearcase cavity 18 and flow directly from the primary exhaust conduit 12 to the idle relief outlet 24 via the intermediate exhaust conduit 20 and optionally the muffler 22. The remainder of the exhaust gas is forced to bypass most of or all of the intermediate exhaust conduit 20 and flow to the gearcase cavity 18 for subsequent discharge to the body of water via the propeller housing outlet 19 and/or to atmosphere via the muffler 22 and idle relief outlet 24, which are connected to the gearcase cavity 18 by a secondary exhaust conduit 28. This example provides the operator with additional active tunability of the sound emanating from the exhaust system 10.

In some examples, the exhaust system 10 can include an operator input device 34 that is mechanically and/or electrically and/or otherwise communicatively coupled to and configured to control the bypass valve 26. The operator input device 34 can be configured such that, via the operator input device 34, an operator can have the ability to selectively position the bypass valve 26 into and out of the open and closed positions, and optionally the intermediate position(s). The type and configuration of the operator input device 34 can vary and the manner in which the operator input device 34 is connected to the bypass valve 26 can vary. In certain non-limiting examples, the operator input device 34 can include one or more mechanical levers, and/or computer keypads, and/or touch screens and/or the like. The operator input device 34 can be configured to directly communicate with and control the position of the operator input device 34 via for example a mechanical, or electronically wired or wireless communication link, an example of which is schematically shown in the drawings. In other examples, the operator input device 34 can be configured to communicate an operator input to the operator input device 34 to a computer controller 35, such as an engine control unit (ECU) that is configured to electronically control the bypass valve 26.

The noted controller 35 can be programmable and include a processor and a memory. The controller 35 can be located anywhere in the system and/or located remote from the system and can communicate with various components of the marine vessel via wired and/or wireless links. In certain examples, the controller 35 is an engine control unit (ECU) that is also configured to control the internal combustion engine and/or other components of the outboard marine engine. Although FIG. 2 schematically shows one controller 35, the system can include more than one controller 35. For example, the system can have a controller 35 located at or near a helm of the marine vessel and can also have one or more controllers located at or near the outboard marine device. Portions of the methods disclosed herein below can be carried out by a single controller or by several separate controllers. Each controller can have one or more control sections or control units. One having ordinary skill in the art will recognize that the controller 35 can have many different forms and is not limited to the example that is shown and described. In some examples, the controller 35 may include a computing system that includes a processing system, storage system, software, and input/output (I/O) interfaces for communicating with devices such as those shown in FIGS. 2 and 3. The processing system loads and executes software from the storage system. When executed by the computing system, software directs the processing system to operate as described herein below in further detail to execute the methods described herein. The computing system may include one or many application modules and one or more processors, which may be communicatively connected. The processing system can comprise a microprocessor and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

Optionally, the exhaust system 10 can include an indicator device 36 that is configured to indicate to the operator a current position of the bypass valve 26. The operator input device 34 and/or indicator device 36 can be located remotely from the outboard marine engine, for example at the helm of the marine vessel, or even remotely from the marine vessel. The type of indicator device 36 can vary. In certain non-limiting examples, the indicator device 36 can include a video or touch screen, and/or flashing lights, and/or the like. The indicator device 36 can be electronically controlled by the controller 35 to indicate to the operator the current position of the bypass valve 26.

Via the operator input device 34, the exemplary system shown in FIGS. 2 and 3 advantageously provides the operator of the outboard marine engine with the ability to actively control the quality and characteristics of exhaust sound emanating from the exhaust system 10. This capability can provide significant advantages in certain settings. For example performance and/or bass boaters can obtain a louder, more aggressive sound quality. Off-shore fisherman or recreational boaters can obtain a quieter, less aggressive sound quality Effectively, these examples transform a traditional passively-controlled exhaust system (A) for an outboard marine engine into a multi-stage exhaust system 10 that can be actively controlled by the operator. The operator can select between through-cowl and through-prop exhaust modes, rather than relying on a passive pressure differential. The exhaust gas can be routed through a muffler 22 prior to exiting the idle relief outlet 24, creating an opportunity to refine the audible exhaust note. This allows the operator to select the sound quality "character" of their choosing, advantageously eliminating a need to provide alternative hardware options to address different market demands with a common engine architecture. In addition, the purchaser of the outboard marine engine no longer needs to choose between one type of sound quality and another, but rather has the ability to change back and forth depending on their wants and needs. These examples thus provide an opportunity to showcase noise-vibration-harshness characteristics that are both quiet and powerful.

An additional initially unforeseen advantage of these examples is their potential to increase horsepower through reduced exhaust gas backpressure as well as reduce risk for water reversion to the internal combustion engine by adding an exhaust circuit at a higher elevation (i.e. above the surface of the body of water 11) on the primary exhaust conduit 12.

Figure 5:
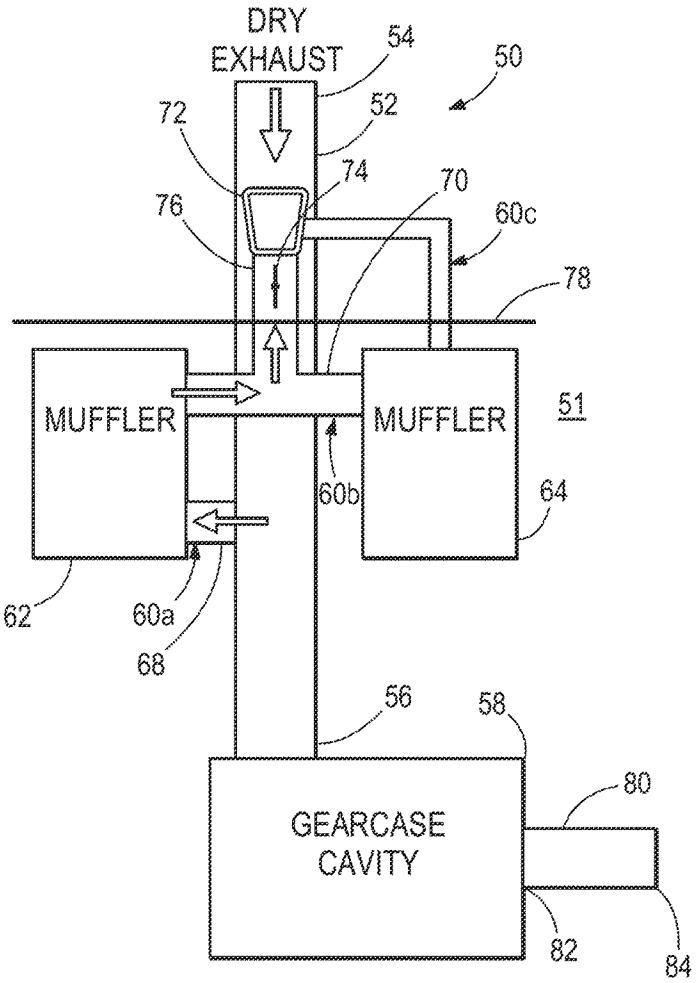
FIG. 5 is another schematic view of the exhaust system shown in FIG. 4.
Figure 4:
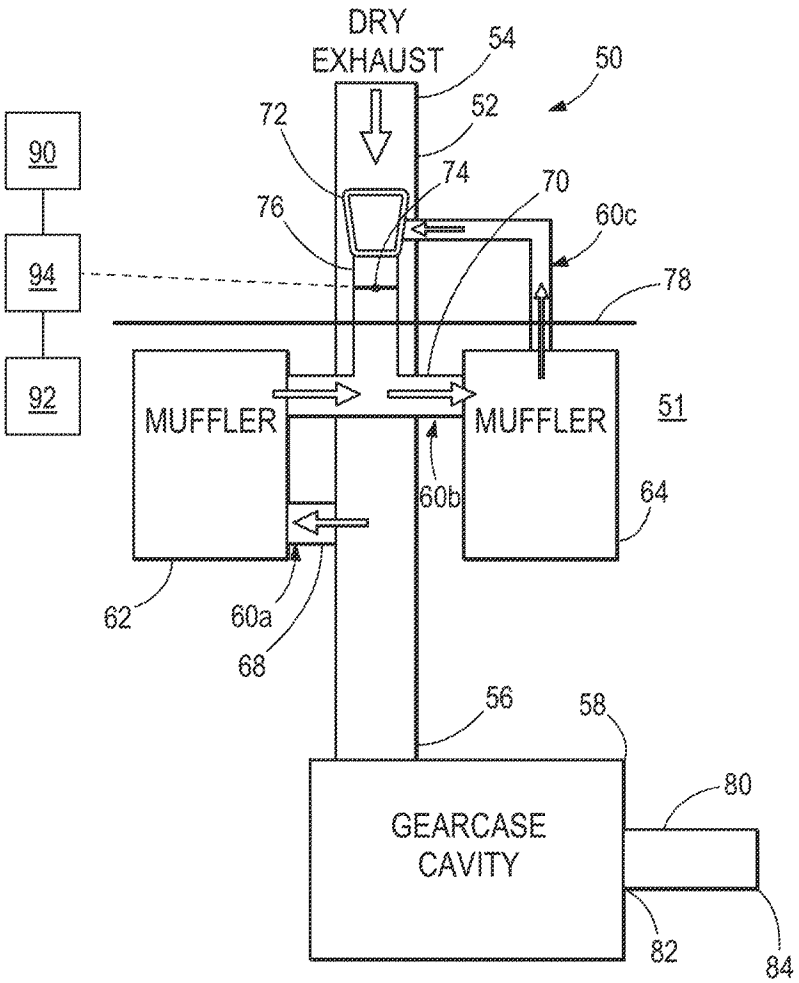
FIG. 4 is a schematic view of a second exemplary exhaust system for an outboard marine engine according to the present disclosure.
Figure 6:
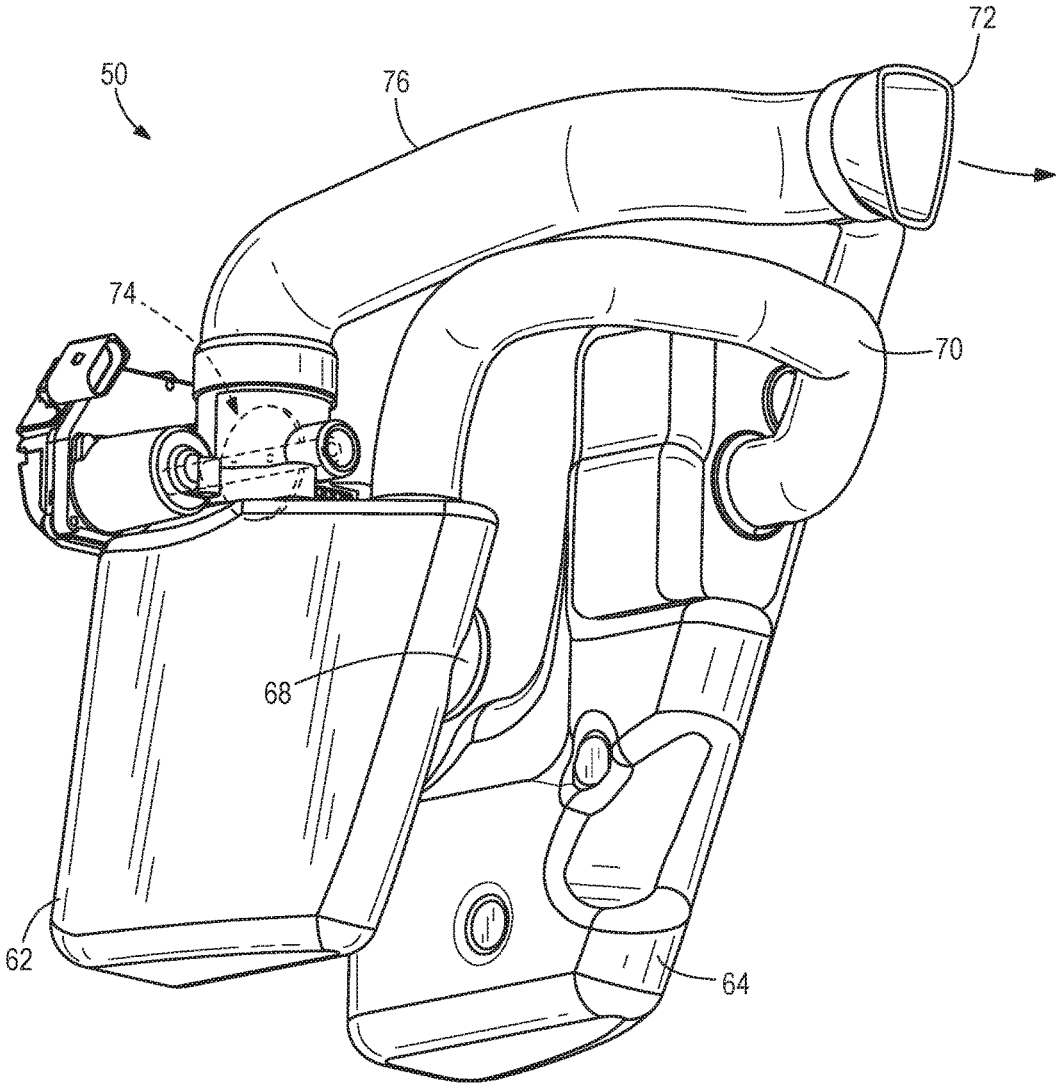
FIGS. 6 and 7 are front and rear perspective views of an exemplary exhaust system in accordance with what is schematically shown in FIGS. 4 and 5.
Figure 7:
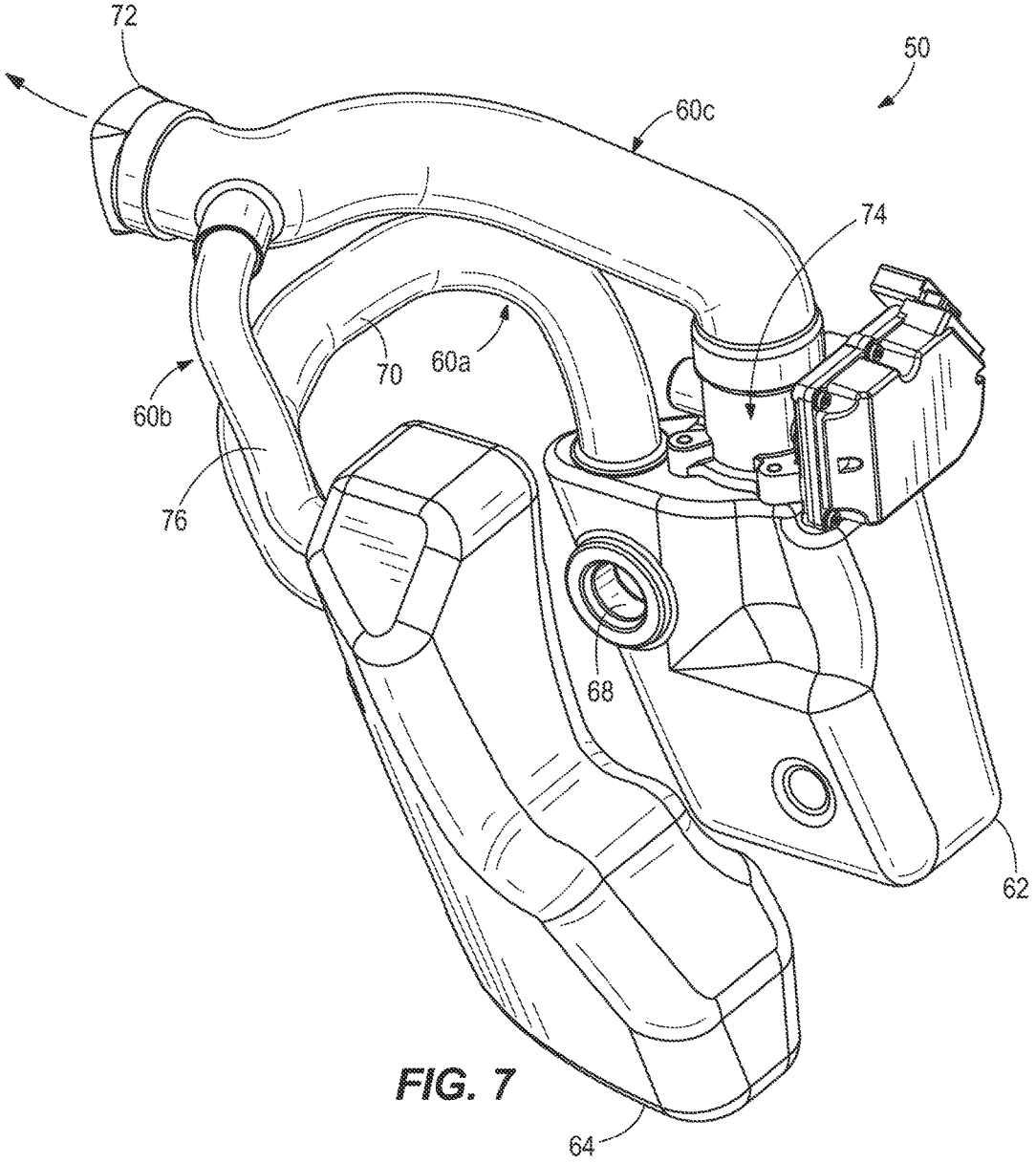

FIGS. 4-7 depict another example of an exhaust system 50 for an outboard marine engine having an internal combustion engine and configured to propel a marine vessel in a body of water 51. FIGS. 4 and 5 are schematic views and FIGS. 6 and 7 are perspective views of certain components.

The exemplary exhaust system 50 includes a primary exhaust conduit 52 having an upstream end 54 that is configured to receive exhaust gas from the noted internal combustion engine and a downstream end 56 that is configured to discharge the exhaust gas to a surrounding body of water 51 via a gearcase cavity 58 and via a secondary exhaust conduit 80. The secondary exhaust conduit 80 has an upstream end 82 configured to receive the exhaust gas from the gearcase cavity 58 and a downstream end 84 configured to discharge the exhaust gas to the body of water 51.

An intermediate exhaust conduit having intermediate exhaust conduit portions 60*a*, 60*b*, 60*c* is coupled to the primary exhaust conduit 52 between the upstream end 54 and downstream end 56 and is configured to receive the exhaust gas from the primary exhaust conduit 52. A primary muffler 62 receives the exhaust gas from the intermediate exhaust conduit portion 60*a*. A secondary muffler 64 receives the exhaust gas from the primary muffler 62 via the intermediate exhaust conduit portion 60*b*. The intermediate exhaust conduit portion 60*a* has an upstream end 68 that receives the exhaust gas from the primary muffler 62. The intermediate exhaust conduit portion 60*b* has a first downstream outlet 70 that discharges the exhaust gas to the secondary muffler 64.

The exhaust system 50 also includes an idle relief outlet 72 that discharges the exhaust gas from the secondary muffler 64 to atmosphere. The idle relief outlet 72 is configured to be located above the body of water in which the outboard marine engine is operated, at least when the outboard marine engine is operated at an idle speed.

A bypass valve 74 is coupled to and/or positioned in the intermediate exhaust conduit portion 60*b* and is positionable into an open position, shown in FIG. 5, wherein the exhaust gas is permitted to bypass the secondary muffler 64 and flow from the primary muffler 62 to the idle relief outlet 72. The intermediate exhaust conduit portion 60*b* has a second downstream end 76 that discharges the exhaust gas to the idle relief outlet 72 when the bypass valve 74 is in the noted open position. The bypass valve 74 is further positionable into a closed position, shown in FIG. 4, wherein the exhaust gas is not permitted to bypass the secondary muffler 64 via the second downstream end 76. Instead the exhaust gas flows from the primary muffler 62 to the idle relief outlet 72 via the first downstream outlet 70 and secondary muffler 64.

In certain examples, the bypass valve 74 is also positionable into one or more intermediate position(s) wherein, compared to the open position, at an idle speed of the internal combustion engine, a reduced amount of exhaust gas is permitted to bypass the secondary muffler 64 and flow from the primary muffler 62 to the idle relief outlet 72. In other words, at an idle speed of the internal combustion engine, in the intermediate position(s) a portion of the exhaust gas is permitted to bypass the secondary muffler 64 and a portion of the exhaust gas is forced to flow through the secondary muffler 64. Both portions are discharged from the outboard marine engine via the idle relief outlet 72. In certain examples, the bypass valve 74 is located at the second downstream end 76 of the intermediate exhaust conduit portion 60*b*, at a location that is on an opposite side of an adapter plate 78 of the outboard marine engine relative to the primary and secondary mufflers 62, 64.

When the bypass valve 74 is in the closed position the exhaust system 50 forms a dual muffler circuit and when the bypass valve 74 is in the open position, the exhaust system includes a single muffler circuit. The exhaust system 50 operates in a "quiet mode" when the bypass valve 74 is in the closed position and the exhaust gas is routed through the more restrictive, increased-transmission-load, dual muffler circuit. The exhaust system 50 operates in a relatively louder "sport mode", when the bypass valve 74 is in the open position and the exhaust gas is routed through the less restrictive, decreased-transmission-load, single muffler circuit.

In certain examples, the exhaust system 50 includes an operator input device 90, an indicator device 92 and/or a computer controller 94, which can be constructed and function in the same manner as the operator input device 34, indicator device 36, and computer controller 35 described herein above with respect to FIGS. 2-3.

An advantage of the example shown in FIGS. 4-8 is that the bypass valve 74 is physically removed from potentially hot, dry exhaust gas in the primary exhaust conduit 52, which could otherwise potentially degrade the operational life of the valve. Instead, the bypass valve 74 is configured to control flow of cooled, wet exhaust gas typically found an idle relief circuit. Also, the bypass valve 74 can advantageously be located under the noted cowling for the internal combustion engine, above the adapter plate 78 and in-line with the idle relief outlet. This lessens the potential damaging or degrading effects of exposure of the bypass valve 74 to the surrounding elements, such as water.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. An exhaust system for an outboard marine engine, wherein the outboard marine engine has an internal combustion engine and is configured to propel a marine vessel in a body of water, the exhaust system comprising:

a primary exhaust conduit having an upstream end configured to receive exhaust gas from the internal combustion engine and a downstream end configured to discharge the exhaust gas to the body of water via a gearcase cavity of the outboard marine engine;

an intermediate exhaust conduit coupled to the primary exhaust conduit between the upstream end and the downstream end, wherein the intermediate exhaust conduit is configured to receive the exhaust gas from the primary exhaust conduit;

an idle relief outlet configured to discharge the exhaust gas to atmosphere, wherein the idle relief outlet is configured to be located above the body of water at least when the outboard marine engine is operated at an idle speed;

a secondary exhaust conduit having an upstream end configured to receive the exhaust gas from the gearcase cavity and a downstream end configured to discharge the exhaust gas to the idle relief outlet; and a bypass valve that is positionable into an open position wherein the exhaust gas is permitted to flow to atmosphere via the intermediate exhaust conduit and into a closed position wherein the exhaust gas is not permitted to flow to atmosphere via the intermediate exhaust conduit.

2. The exhaust system according to claim 1, further comprising a muffler that receives the exhaust gas from the intermediate exhaust conduit; and wherein the secondary exhaust conduit is configured to discharge the exhaust gas to the idle relief outlet via the muffler.

3. The exhaust system according to claim 1, wherein the bypass valve is further positionable into an intermediate position wherein, as compared to the open position, a reduced amount of the exhaust gas is permitted to flow to atmosphere via the intermediate exhaust conduit.

4. The exhaust system according to claim 1, further comprising an operator input device via which an operator can control the bypass valve into and out of the open and closed positions.

5. The exhaust system according to claim 1, further comprising an indicator device that indicates to an operator a current position of the bypass valve.

6. An exhaust system for an outboard marine engine, wherein the outboard marine engine has an internal combustion engine and is configured to propel a marine vessel in a body of water, the exhaust system comprising:

a primary exhaust conduit having an upstream end configured to receive exhaust gas from the internal combustion engine and a downstream end configured to discharge the exhaust gas to the body of water via a gearcase cavity;

an intermediate exhaust conduit coupled to the primary exhaust conduit between the upstream end and the downstream end, wherein the intermediate exhaust conduit is configured to receive the exhaust gas from the primary exhaust conduit;

a primary muffler that receives the exhaust gas from primary exhaust conduit via the intermediate exhaust conduit;

a secondary muffler that receives the exhaust gas from the primary muffler via the intermediate exhaust conduit;

an idle relief outlet that discharges the exhaust gas from the secondary muffler to atmosphere, wherein the idle relief outlet is configured to be located above the body of water at least when the outboard marine engine is operated at an idle speed;

a secondary exhaust conduit having an upstream end configured to receive the exhaust gas from the gearcase cavity and a downstream end configured to discharge the exhaust gas to the idle relief outlet; and a bypass valve that is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

7. The exhaust system according to claim 6, wherein the bypass valve is further positionable into an intermediate position wherein, as compared to the open position, a reduced amount of the exhaust gas is permitted to bypass the secondary muffler and flow from the primary muffler to the idle relief outlet.

8. The exhaust system according to claim 6, wherein the intermediate exhaust conduit comprises a portion having an upstream end that receives the exhaust gas from the primary muffler, a first downstream end that discharges the exhaust gas to the secondary muffler, and a second downstream end that discharges the exhaust gas to the idle relief outlet when the bypass valve is in the open position.

9. The exhaust system according to claim 8, wherein the bypass valve located at the second downstream end of the portion of the intermediate exhaust conduit.

10. The exhaust system according to claim 6, further comprising an operator input device via which an operator can control the bypass valve into and out of the open and closed positions.

11. The exhaust system according to claim 6, further comprising an indicator device that indicates to an operator a current position of the bypass valve.

12. An exhaust system for an outboard marine engine, wherein the outboard marine engine has an internal combustion engine and is configured to propel a marine vessel in a body of water, the exhaust system comprising:

a primary exhaust conduit having an upstream end configured to receive exhaust gas from the internal combustion engine and a downstream end configured to discharge the exhaust gas to the body of water via a gearcase cavity;

an intermediate exhaust conduit coupled to the primary exhaust conduit between the upstream end and the downstream end, wherein the intermediate exhaust conduit is configured to receive the exhaust gas from the primary exhaust conduit;

a primary muffler that receives the exhaust gas from primary exhaust conduit via the intermediate exhaust conduit;

a secondary muffler that receives the exhaust gas from the primary muffler via the intermediate exhaust conduit;

an idle relief outlet that discharges the exhaust gas from the secondary muffler to atmosphere, wherein the idle relief outlet is configured to be located above the body of water at least when the outboard marine engine is operated at an idle speed; and a bypass valve that is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler;

wherein the bypass valve is configured to be located on an opposite side of an adapter plate of the outboard marine engine relative to the primary and secondary mufflers.

13. An outboard marine engine configured to propel a marine vessel in a body of water, the outboard marine engine comprising:

an internal combustion engine;

a gearcase located below the internal combustion engine;

a primary exhaust conduit having an upstream end configured to receive exhaust gas from the internal combustion engine and a downstream end configured to discharge the exhaust gas to the body of water via the gearcase cavity;

an intermediate exhaust conduit coupled to the primary exhaust conduit between the upstream end and the downstream end, wherein the intermediate exhaust conduit is configured to receive the exhaust gas from the primary exhaust conduit;

a primary muffler that receives the exhaust gas from the primary exhaust conduit via the intermediate exhaust conduit;

a secondary muffler that receives the exhaust gas from the primary muffler via the intermediate exhaust conduit;

an idle relief outlet that discharges the exhaust gas from the secondary muffler to atmosphere, wherein the idle relief outlet is configured to be located above the body of water at least when the outboard marine engine is operated at an idle speed; and a bypass valve that is positionable into an open position wherein the exhaust gas is permitted to bypass the secondary muffler and flow from the primary muffler to the idle relief outlet and into a closed position wherein the exhaust gas is not permitted to bypass the secondary muffler and instead flows from the primary muffler to the idle relief outlet via the secondary muffler.

14. The outboard marine engine according to claim 13, wherein the bypass valve is further positionable into an intermediate position wherein, as compared to the open position, a reduced amount of the exhaust gas is permitted to bypass the secondary muffler and flow from the primary muffler to the idle relief outlet.

15. The outboard marine engine according to 13, wherein the intermediate exhaust conduit comprises a portion having an upstream end that receives the exhaust gas from the primary muffler, a first downstream end that discharges the exhaust gas to the secondary muffler, and a second downstream end that discharges the exhaust gas to the idle relief outlet when the bypass valve is in the open position.

16. The outboard marine engine according to claim 15, wherein the bypass valve is located at the second downstream end of the portion of the intermediate exhaust conduit.

17. The outboard marine engine according to claim 13, further comprising a secondary exhaust conduit having an upstream end configured to receive the exhaust gas from the gearcase cavity and a downstream end configured to discharge the exhaust gas to the body of water.

18. The outboard marine engine according to claim 13, further comprising an adapter plate located between the internal combustion engine and the gearcase housing, wherein the bypass valve is configured to be located on an opposite side of the adapter plate relative to the primary and secondary mufflers.

19. The outboard marine engine according to claim 13, wherein when the bypass valve is in the closed position, the exhaust system forms a dual muffler circuit and wherein when the bypass valve is in the open position, the exhaust system forms a single muffler circuit.

* * * * *